United States Patent [19]

Kropkowski

[11] Patent Number: 4,877,246

[45] Date of Patent: Oct. 31, 1989

[54] MIXING AND DISPENSING APPARATUS FOR GAME

[76] Inventor: James M. Kropkowski, 1012 Henderson Blvd., Fair Lawn, N.J. 07410

[21] Appl. No.: 883,178

[22] Filed: Jul. 8, 1986

[51] Int. Cl.[4] ..... A63B 71/00

[52] U.S. Cl. ..... 273/144 R; 221/203; 193/17

[58] Field of Search ..... 273/144 A, 144 R, 144 B, 273/145 E, 11 C, 86 C, 121 D, 122 R, 122 A, 123, 201, 124 R, 111; 193/10, 4, 6, 5, 7, 17; 221/203, 167, 159, 164, 186

[56] References Cited

U.S. PATENT DOCUMENTS

| | | | |
|---|---|---|---|
| 465,739 | 12/1891 | Guerlcke | 273/144 B |
| 823,687 | 6/1906 | Kindling | 273/11 C |
| 2,001,366 | 5/1935 | Mittelman | 273/144 R |
| 2,003,979 | 6/1935 | Skoric . | |
| 2,087,221 | 7/1937 | MacClatchie et al. | 273/144 R |
| 2,334,094 | 11/1943 | Hickey | 273/144 A |
| 2,349,623 | 6/1942 | Hickey | 273/144 A |
| 2,490,144 | 12/1949 | Masten | 273/144 A |
| 2,639,006 | 9/1949 | Golwynne | 193/17 |
| 2,704,669 | 3/1955 | Hickey | 273/144 A |
| 2,721,083 | 10/1955 | Allain | 273/144 A |
| 2,731,268 | 1/1956 | Raizem | 221/167 |
| 3,140,875 | 7/1964 | Abbot et al. | 273/144 R |
| 3,466,045 | 9/1969 | Walton | 273/144 R |
| 4,616,831 | 10/1986 | Testerman | 273/144 B |

FOREIGN PATENT DOCUMENTS 1181008 2/1970 United Kingdom ..... 273/144 B

OTHER PUBLICATIONS

U.S. #4,373,728/2/15/83/Korzenletz 273-144 B.

*Primary Examiner*—Edward M. Cohen
*Assistant Examiner*—Mark S. Graham
*Attorney, Agent, or Firm*—Weingram & Zall

[57] ABSTRACT

The device mixes and selects a plurality of game balls sequentially and includes a rotating chamber which contains a plurality of balls located in the bottom portion thereof. The chamber has a plurality of cups mounted interiorly thereof, the cups being capable of sequentially selecting one of the balls when the chamber is rotated in the first direction and mixing the balls when the chamber is rotated in the second direction. The cups select a ball and convey it to a predetermined exit location. A first ramp is located at the exit location. A second ramp coacts with the first ramp and conveys the balls to a point. A third ramp coacts with the second ramp and is pivotedly mounted about the point. A protrusion is connected across the third ramp for inhibiting further movement of the selected balls when the ramp is in a first position and for permitting the balls to pass beneath the protrusion when the ramp is in its second pivoted position. A fourth ramp coacts with the third ramp and is located to receive the balls after the ramp is pivoted and return the balls to the bottom portion of the chamber.

1 Claim, 3 Drawing Sheets

MIXING AND DISPENSING APPARATUS FOR GAME

BACKGROUND OF THE INVENTION

1. Field of the Invention

The present invention relates to mixing and dispensing apparatus for games and specifically games which involve the random selection of balls or other pellets bearing indicia which can be utilized, for example, to play the lottery, select colors, or other game functions. The device can be manufactured in small battery operated versions for use of the home, can be unpowered and utilized manually or can be manufactured in larger versions for use at various public functions such as a lottery, bingo, or in casinos.

2. Description of the Prior Art

The prior art discloses various devices for mixing balls or other shaped objects and then serially and randomly selecting one of them in sequence. GUERICKE U.S. Pat. No. 465,739 drops balls to a tray as a handle is rotated. A groove is shown for holding the balls which are selected. NOSE U.S. Pat. No. 1,661,048 discloses the use of a two-way rotating container rotating in one direction to mix the balls and in a second direction to select the balls one by one. SKORIC U.S. Pat. No. 2,003,979 discloses a rotating drum type mixing device for the purpose of selecting balls for use in a game. The device has a frame located within the container affixed on a shaft which moves along the shaft to mix the balls. HICKEY U.S. Pat. No. 2,349,623 again utilizes bidirectional rotation for mixing in one direction and selecting in the other direction for game balls. The lifting is accomplished by forming the mixing elements as pockets so they catch the balls when rotated in the proper direction.

MASTEN U.S. Pat. No. 2,490,144 utilizes a number of mixing devices which engage and interact with balls to be selected in a lottery machine. This device does not utilize a cup or other structure to lift the balls from a lower point to a higher point to select same and exit same from the mixing chamber.

ALLAIN U.S. Pat. No. 2,721,083 discloses a rotating turntable operating under motor control with the balls selected by a spring-loaded plunger arrangement. RAIZEN U.S. Pat. No. 2,731,268 shows rotation for selection of bingo tokens. The rotation brings a selected token up to the desired exit point at the top of the mixing chamber. WALTON U.S. Pat. No. 3,466,045 teaches an electronic selection device which relies on ball contact to complete an electrical circuit and then trigger a device to select the ball which completes the electric circuit. ERNST U.S. Pat. No. 3,468,542 utilizes bi-directional rotation of a drum. The patent to KORZENIETZ U.S. Pat. No. 4,373,728 mixes two different colored balls in the mixing reservoir at the base. Gravity then drops the balls down to pockets on a wheel and the numbers are determined by what color balls drops into which pocket of the wheel.

The prior art devices do not show the various structural features of applicant's device which provide in one design, the ability to manufacture various such machines for different game environments such as the casino, the home, and the public selection of winners as in the case of selection of lottery winners.

SUMMARY OF THE INVENTION

The preferred embodiment of the invention consists of an apparatus which is motor driven and will be described for battery operation and will also be described for use and selecting numbers as in a lottery. A rotatable clear plastic drum is driven by a battery operated motor. A two position switch allows the drum to be rotated in one direction for mixing and in a second direction for selection. The selection occurs when the drum is rotated in the proper direction so that pockets formed interiorly on the rotating drum pass through the collection of numbered balls located at the bottom of the drum and, by virtue of the size of the pocket, one ball is selected. The ball is then carried upwards by the continued rotation of the drum until the ball reaches a predetermined point. An aperture which may be provided with a corresponding shaped "catching" pocket is located interiorly of the drum for receiving the balls from the pockets. The ball drops from the pocket when the pocket reaches a predetermined point in the drum's rotation. The ball is, in turn, carried from the release point via a series of ramps. A first inclined ramp carries the ball from the exit point to a first location. A second ramp carries the ball from the first location to a second location. A third ramp carries the ball to a barrier provided at the end of the third ramp. The barrier stops the balls and inhibits them from further movement.

A fourth ramp is located downstream from said barrier.

This fourth ramp returns the balls to the bottom of the drum on their release from the barrier.

In the preferred embodiment, the third ramp is spring mounted and lever actuated to tip the third ramp such that the balls can rotate free of and beneath the barrier. Tipping is accomplished through the use of the lever which is manually operated. The lever forces the ramp to tip against the bias of the spring.

The drum and the various ramps and paths for the balls may be of clear material so as to enable the operator and the spectators to visualize the progress of the game balls through the device. The barrier is provided to hold the balls as they stack up in the third ramp to provide a location where the indicia on the balls can be seen by all concerned.

An object of the present invention is the provision of a design for a mixing and selection device which design can be implemented in various size configurations for use in the home, casino, or other public location.

Another object of the present invention is the provision of a mixing device for games wherein a plurality of balls are placed in a rotating drum.

A principal object of the invention is the use of a drum to mix balls when rotated in a first direction and to select the balls when the drum is rotated in the opposite direction.

A further object of the present invention is the provision of a mixing drum wherein balls can be selected one at a time by the passage of pockets for carrying said balls through the mixing point of the balls.

A further object of the present invention is the provision of a selection mechanism for a plurality of game balls which has a take-off ramp located at the exit point for catching the balls as each one is released from its respective selection pocket.

A further object of the present invention is the provision of a barrier to stop the balls for as long as desired.

Another object of the present invention is the provision of a mechanism for releasing the balls from the inhibition of the barrier by tipping the ramp carrying the balls.

Another object of the present invention is the provision of a gaming device for selection of balls randomly the device including pathways containing a series of ramps to control the balls, inhibit their movement, and return the balls to the mixing container, respectively.

These as well as further objects and advantages of the invention will become apparent to those skilled in the art from a review of the following specification reference being made to the accompanying drawings in which:

BRIEF DESCRIPTION OF DRAWINGS

Referring now to FIGS. 1-3, and specifically with reference to FIG. 1, the device in accordance with the invention is shown generally at reference numeral 10. The device consists of a drum 12 which is rotatable in both the clockwise and counterclockwise directions. The drum 12 has a plurality of balls 42 located in random fashion at the bottom of the drum. A shaft 14 mounts the drum for rotation thereabout. The plurality of pockets such as 16 and 18 are formed on the interior rotating surface of the drum 12. These pockets serve to mix the balls when the drum is rotated in the counterclockwise direction and to pick up and select one ball when the drum is rotated in the clockwise direction. The drum is formed of an integral back surface 68 and a side surface 66. However, the drum's proximal surface 54, as best seen in FIGS. 1 and 3 forms a non-contacting cover for what would normally be the open drum. The cover 54 is stationary and does not rotate. As will be described below, there is mounted on cover 54 a cup 20 for receiving the balls from the pockets 16, 18 and a first ramp 22 for conveying the balls received from the cup 22 to another ramp.

Figure 1:
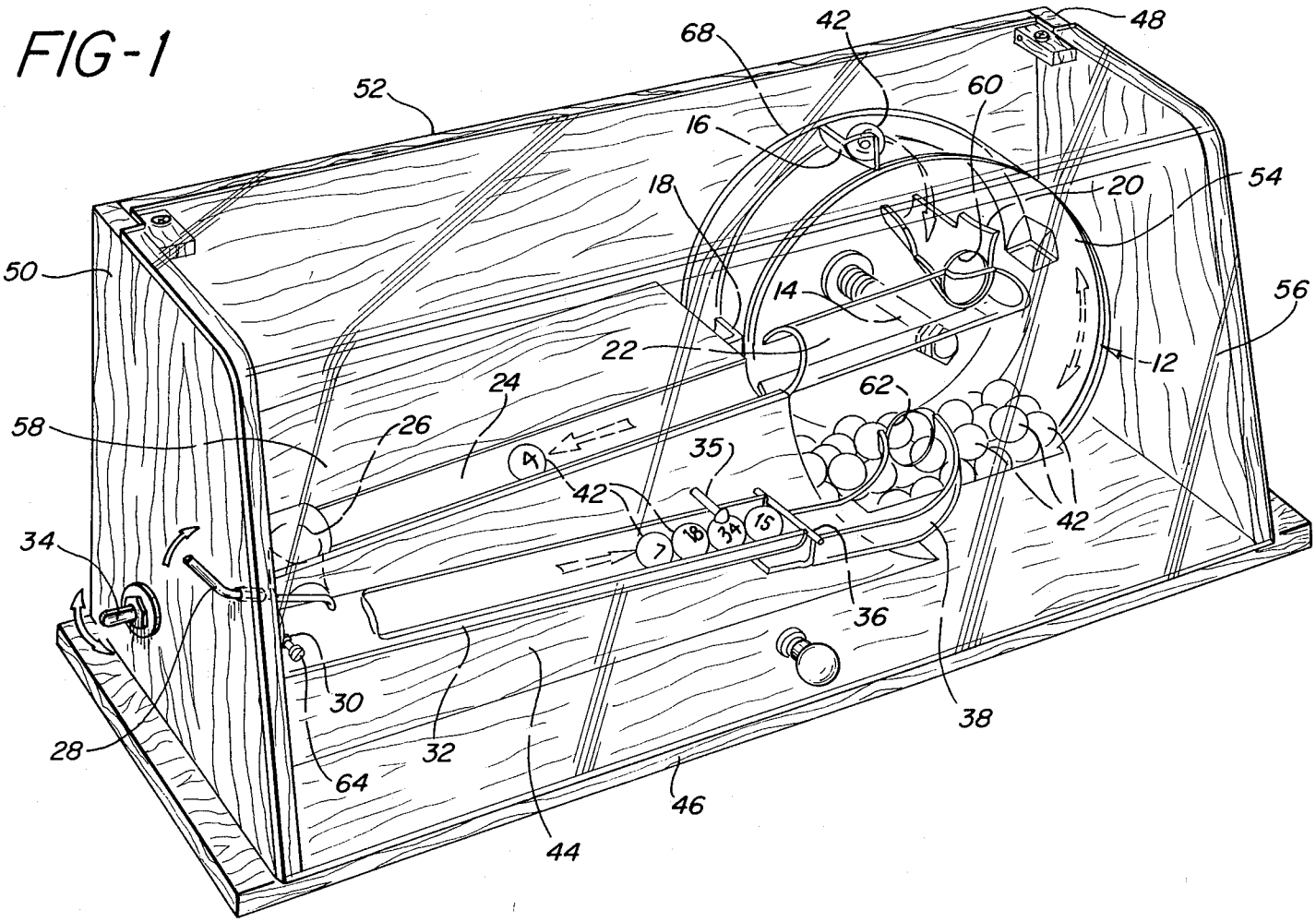
FIG. 1 is a perspective view of the device in accordance with the invention.

In addition, and also affixed to the non-rotating cover 54 is a ball return ramp 38. Apertures 60 and 62 respectively allow the balls to exit through the cover 54 to first ramp 22 and to return via return ramp 38 through cover 54 into drum 12.

The first ramp 22, fixedly mounted to stationary drum cover 54, conveys the balls to a second ramp 24 formed on a ramp support cover 58. The ramp 24 conveys the selected balls to a hole 26 in cover 58. The hole 26 communicates between the ramp 24 and a third ramp 32. This third ramp 32 is pivotedly mounted, as will be discussed, about a pivot point 64.

The cover 58 forms the top of a housing for, if required, a motor, its gearing and its batteries (not shown) for the device.

Figure 2:
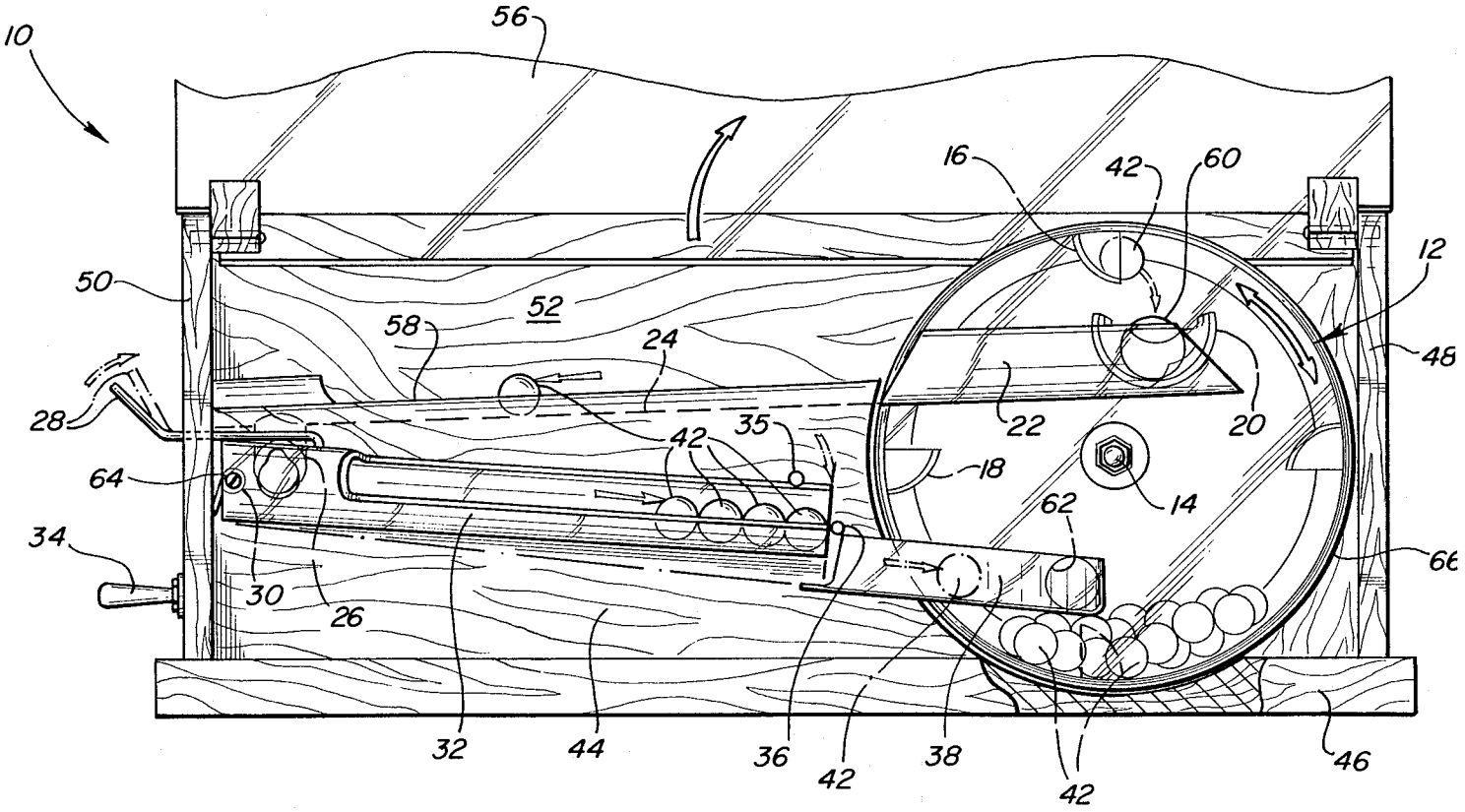
FIG. 2 is a front elevational view of the invention with the cover in the up position.
Figure 3:
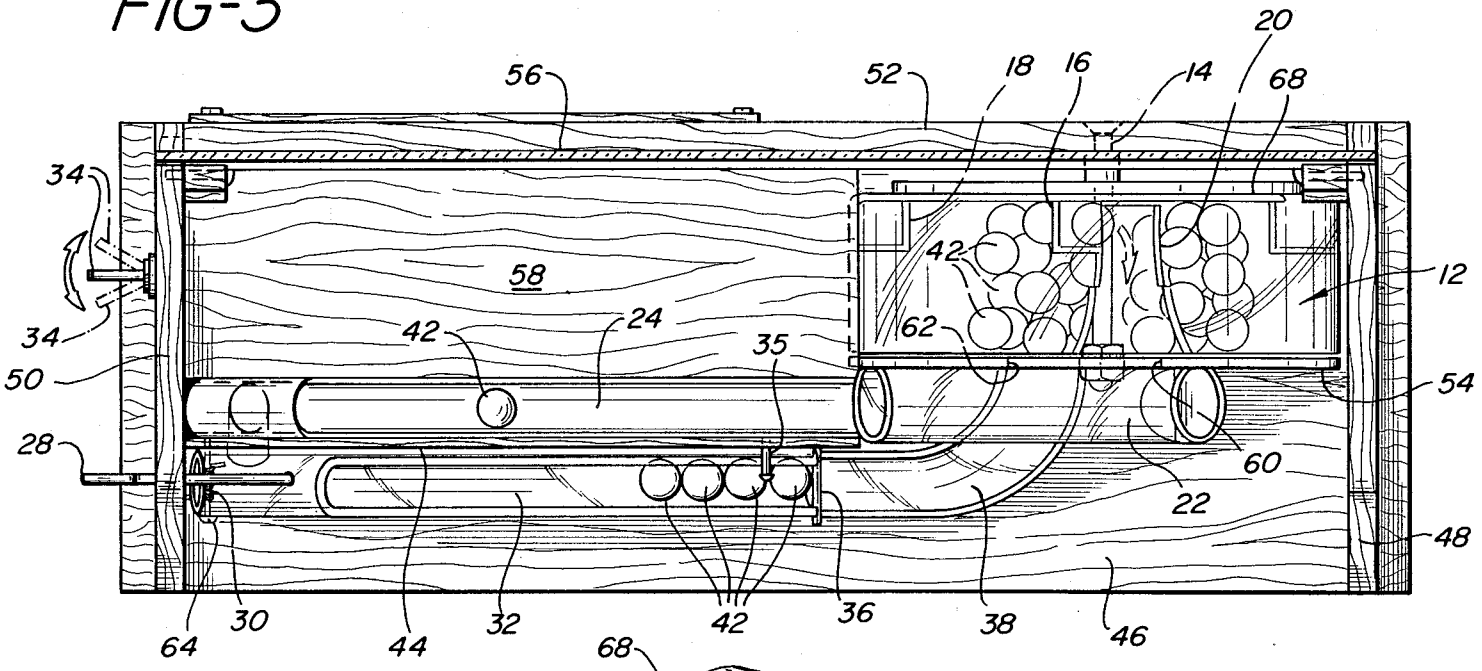
FIG. 3 is a top plan view of FIG. 2.

A spring 30 urges pivoting ramp 32 to its uppermost position as seen in FIGS. 1, 2 and 3. A lever handle 28 extends from pivoting ramp 32 outwards of the housing to be operated manually to pivot the ramp. As best seen in FIG. 2, in phantom linework, the lever handle 28, when urged upwards, forces the ramp 32 to move downward, thereby releasing the selected balls to return to drum 12 by way of ramp 28.

As shown in FIG. 1, the entire assembly of the device is mounted on a base 46 having a first side wall 48 and a second side wall 50. The lever handle 28 may extend through the side support 50 so as to be operable from the exterior of housing wall 50. Additionally, a stop pin 35 is provided to restrain ramp 32 to maintain a proper slope to allow the balls 42 to move freely.

Also visible in FIGS. 1, 2 and 3 is an electrical switch 34 mounted in side wall 50. The switch is a three position switch which has an "off" position and first and second "on" positions. The two "on" positions, respectively cause the drum 12 to rotate in either clockwise or counterclockwise directions.

A barrier 36, in the form of a pin, is located at the lower end of pivoting ramp 32. As will now be seen, the balls traverse from ramp 22 along ramp 24 down through aperture 26 to pivoting ramp 32 and are stopped by barrier 36. In the preferred embodiment, barrier 36 is a pin protrusion mounted to the front face of a support 44 forming part of the motor/battery housing. The selected balls are thus inhibited from further passage by barrier 36. To release the balls, lever 28 is manipulated causing pivoting ramp 32 to pivot about point 64 against the force of spring 30, lowering the lower portion of ramp 32 (the end nearest the barrier 36. The degree of travel of ramp 32 is sufficient to enable the balls to pass beneath the barrier 36 and continue for further passage.

As the balls pass beneath the barrier 36 (because the ramp 32 has been tipped about pivot point 64) the balls pass onto a fourth ramp 38. This ramp, fixedly mounted to cover 54, allows the balls to return to the group of balls 42 at the bottom of the rotating drum 12. The balls pass along ramp 38 and into drum 12 via aperture 62 in cover 54.

As seen in FIG. 2, if desired, the entire mechanism may be covered by a clear plastic cover 56. The cover is hingedly mounted by hinges such as 62 mounted in the two side support walls 48 and 50. The support shaft 14 is fixedly mounted in the back wall 52 of the device. Rotation of the rotating drum 12 may be accomplished manually, or by electric motor which may be either directly coupled to the shaft 14 or the drum 12, or can be coupled thereto by suitable gearing.

Figure 4:
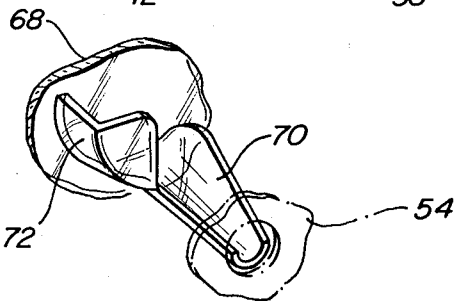
FIG. 4 is a perspective view of a modification of FIGS. 1-3.

FIG. 4 shows a variation on the design of the pick-up cups 16 and 18 described in connection with FIGS. 1-3 above. In FIG. 4, the cups are each shaped having their own exit portion formed integrally therewith. With this configuration, it is the cups which, themselves, cause the ball to exit from the ball carrying portion of the cup to the first exit ramp 22 through aperture 60. This configuration eliminates the need for the cup exit portion 20 described in FIGS. 1-3 above for catching the balls as they exit from the pick up cups 16 and 18.

More particularly, a cup 72 is shown in FIG. 4 having an elongated, tapered exit portion 70 formed integrally therewith. The exit portion 70 is sufficiently shallow to preclude the balls from being picked up by this portion of the pick-up cup 72. Thus, when a pick-up cup 72 with a selected ball therein reaches a position in its upward travel, the ball will exit the cup, travel along portion 70 into aperture 60 and then follow the pathways described in connection with FIGS. 1-3 above.

As modifications to the foregoing may be made therein without departing from the spirit and scope of my invention, what is desired to be covered by United States Letter Patent as set forth in the appended claims.

I claim:

1. A device for mixing and selecting a plurality of balls said device comprising:

a base;

first and second side walls mounted on said base;

a back wall mounted on said base and affixed to said side walls;

shaft means mounted for rotation in said back wall;

a rotating cylindrical container coupled to said shaft means and rotatably mounted thereon;

a cover mounted on said shaft means, said cover enclosing said rotating container , a ramp support cover mounted on said back wall and extending outwardly therefrom to form an inclined surface;

ramp means for permitting the balls to pass therealong formed integrally on said ramp support cover;

an aperture formed in said ramp support cover for permitting said balls to pass from a first ramp to a first location;

a second ramp means pivotedly mounted about said first location beneath said aperture;

means coupled to said second ramp means for pivoting same about said first location;

means coacting with said pivoting ramp means for inhibiting said selected balls from passing further along said pivoting ramp means when said ramp is in a first position and permitting balls to pass beneath said inhibiting means when said pivoting ramp means is in its second, pivoted position;

third ramp means coupled to said cover for returning said selected balls to said container on pivoting said pivoting ramp means to its second position ; all of said ramp means providing a continuous path for said balls.

* * * * *